US007052409B2

(12) United States Patent
Goldsmith

(10) Patent No.: US 7,052,409 B2
(45) Date of Patent: May 30, 2006

(54) PLANAR-PARALLACTIC GOLF ALIGNMENT AIDE

(76) Inventor: Jason Goldsmith, 990 Manor Way, San Diego, CA (US) 92106

( * ) Notice: Subject to any disclaimer, the term of this patent is extended or adjusted under 35 U.S.C. 154(b) by 0 days.

(21) Appl. No.: 10/808,710

(22) Filed: Mar. 22, 2004

(65) Prior Publication Data

US 2004/0266543 A1 Dec. 30, 2004

Related U.S. Application Data

(63) Continuation of application No. 10/608,456, filed on Jun. 26, 2003.

(51) Int. Cl.
*A63B 53/04* (2006.01)

(52) U.S. Cl. ..... 473/242; 473/254; 473/253

(58) Field of Classification Search ..... 473/240, 473/253–254, 249–250, 340–341, 251, 242
See application file for complete search history.

(56) References Cited

U.S. PATENT DOCUMENTS 3,880,430 A * 4/1975 McCabe ..... 473/253
4,136,877 A * 1/1979 Antonious ..... 473/254
4,343,472 A * 8/1982 Hamilton ..... 473/240
4,367,877 A * 1/1983 Gibson et al. ..... 473/240
4,458,900 A * 7/1984 Antonious ..... 473/254
4,749,196 A * 6/1988 Podgor ..... 473/250
4,986,544 A * 1/1991 Benson ..... 473/254
5,275,412 A * 1/1994 Innes ..... 473/253
5,351,963 A * 10/1994 Baek ..... 473/241
5,409,228 A * 4/1995 Botsch ..... 473/249
5,676,603 A * 10/1997 Miller ..... 473/220
5,921,868 A * 7/1999 DiMartino ..... 473/254
6,062,986 A * 5/2000 Kaise ..... 473/242
2005/0227783 A1* 10/2005 Olsavsky et al. ..... 473/340

* cited by examiner

*Primary Examiner*—Sebastiano Passaniti
(74) *Attorney, Agent, or Firm*—Steins & Associates, P.C.

(57) ABSTRACT

A Planar-Parallactic Golf Alignment Aide is disclosed. Also disclosed is a device that provides the golfer with a planar alignment sight line for aligning the club face with the target. The invention further provides the golfer with a parallactic alignment sight line for placing his or her head in the proper and repeatable position in order to eliminate unintentional stance variations. The aide may be incorporated within the club head and operate by aligning an aperture or line with the projected image of that aperture or line to use the phenomena of parallax for head alignment. The aperture or line is formed in the top of a dome, and the projected image then appears on a projection surface below the dome. The device may either be an attachment for a conventional club head, or may incorporated into the head itself.

17 Claims, 10 Drawing Sheets

A - A

PLANAR-PARALLACTIC GOLF ALIGNMENT AIDE

This application is a continuation of application Ser. No. 10/608,456, filed Jun. 26, 2003, now pending.

BACKGROUND OF THE INVENTION

1. Field of the Invention

This invention relates generally to golf technique aids and, more specifically, to a Planar-Parallactic Golf Alignment Aide.

2. Description of Related Art

Golf equipment manufacturers have brought many different devices to the consumer in order to aid the golfer in improving their game. There are two general areas emphasized by golf technique aids—those that assist the golfer in his or her stance/approach to the ball, and those that assist the golfer in aligning the club so that the ball will travel in the desired direction. One example of the former is found in FIG. 1.

FIG. 1 depicts the prior art golf alignment aid of D'Amico, U.S. Pat. No. 5,536,012. The "golf club including positioning aid" disclosed by D'Amico includes one or more apertures 14 formed through the shaft 12 or handle of the golf club. In order to correctly align the body to the club prior to the swing using the D'Amico, the golfer 16 aligns his/her body such that his or her eye 18 is aligned with one of the apertures 14. When the sight line 20 is correctly aligned, the golfer 16 will be able to see light through the aperture 14. One problem with the D'Amico device is that it fails to aid the golfer in aligning the club face to the desired destination. FIG. 2 is another design intended to assist the golfer in positioning the head and body relative to the club and ball.

FIG. 2 depicts the prior art golf alignment aid of Sykes, U.S. Pat. No. 3,548,504. The "sighting device for establishing a line of sight" of Sykes is a protrusion for mounting to the top of a conventional golf club head. The device 22 has a base 28 mounted to the head 24. A "far sight section" 30 is located atop the base 28, and a "near sight section" 32 extends upwardly from the far sight section 30. Similar to D'Amico, with Sykes the golfer aligns his or her head in the correct position, whereby the near sight section 32 and far sight section 30 are being viewed from directly above—in this position, the near sight section 32 will appear to be a dot that is in the center of a circle (the far sight section 30). As with D'Amico, the Sykes device fails to aid the golfer in aligning the club face with the hole (or other desired destination for the ball).

The face-hole alignment issue is extremely important when putting, and FIG. 3 depicts a prior putter that assists the golfer in this alignment. FIG. 3 depicts the prior art golf club alignment aid known as the "2-ball" head 34 made by Callaway Golf™. The 2-ball head 34 has a club head 36 defined by a face 40 and a top surface 42. The top surface has a first ball image 44 and a second ball image 46 in planar alignment with the planar alignment line 50. Generally speaking, the planar alignment line 50 is an imaginary line that extends perpendicular to the face 40, and is assumed to be the direction in which a ball 48 will travel if struck with the face 40.

To use the 2-ball club, the user simply aligns the first and second ball images 44 and 46, respectively, with the actual ball 48 so that the planar alignment line 50 is created by connecting the centers of the two images 44 and 46 and the ball 48. By doing so, the golfer is both aligning the center of the face (horizontally) with the ball 48, as well as aligning the club face 40 with the hole (or other desired destination for the ball 48). The 2-ball club head has apparently been successful as evidenced by its wide popularity with amateur golfers.

The problem with the 2-ball head 34 is that it does not really aid the golfer in positioning his or her head and body with the club or ball so that the golfer's stance and (hopefully) swing is correct. What is needed is an improved golf club head design that provides the golfer with a planar alignment tool (i.e. to align the club face in the direction of the shot), as well as providing an aid for the stance relative to the ball and club so that the swing is also improved.

SUMMARY OF THE INVENTION

In light of the aforementioned problems associated with the prior devices and assemblies, it is an object of the present invention to provide a Planar-Parallactic Golf Alignment Aide. The invention should provide the golfer with a planar alignment sight line for aligning the club face with the target. The invention should further provide the golfer with a parallactic alignment sight line for placing his or her head in the proper and repeatable position (to eliminate unintentional stance variations). The aide should be incorporated within the club head and operate by aligning an aperture or line with the projected image of that aperture or line to use the phenomena of parallax for head alignment. The aperture or line should be formed in the top of a dome, and the projected image should appear on a projection surface below the dome. The device should be an attachment for a conventional club head, or should incorporated into the head itself.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Planar-Parallactic Golf Alignment Aide.

Figure 1:
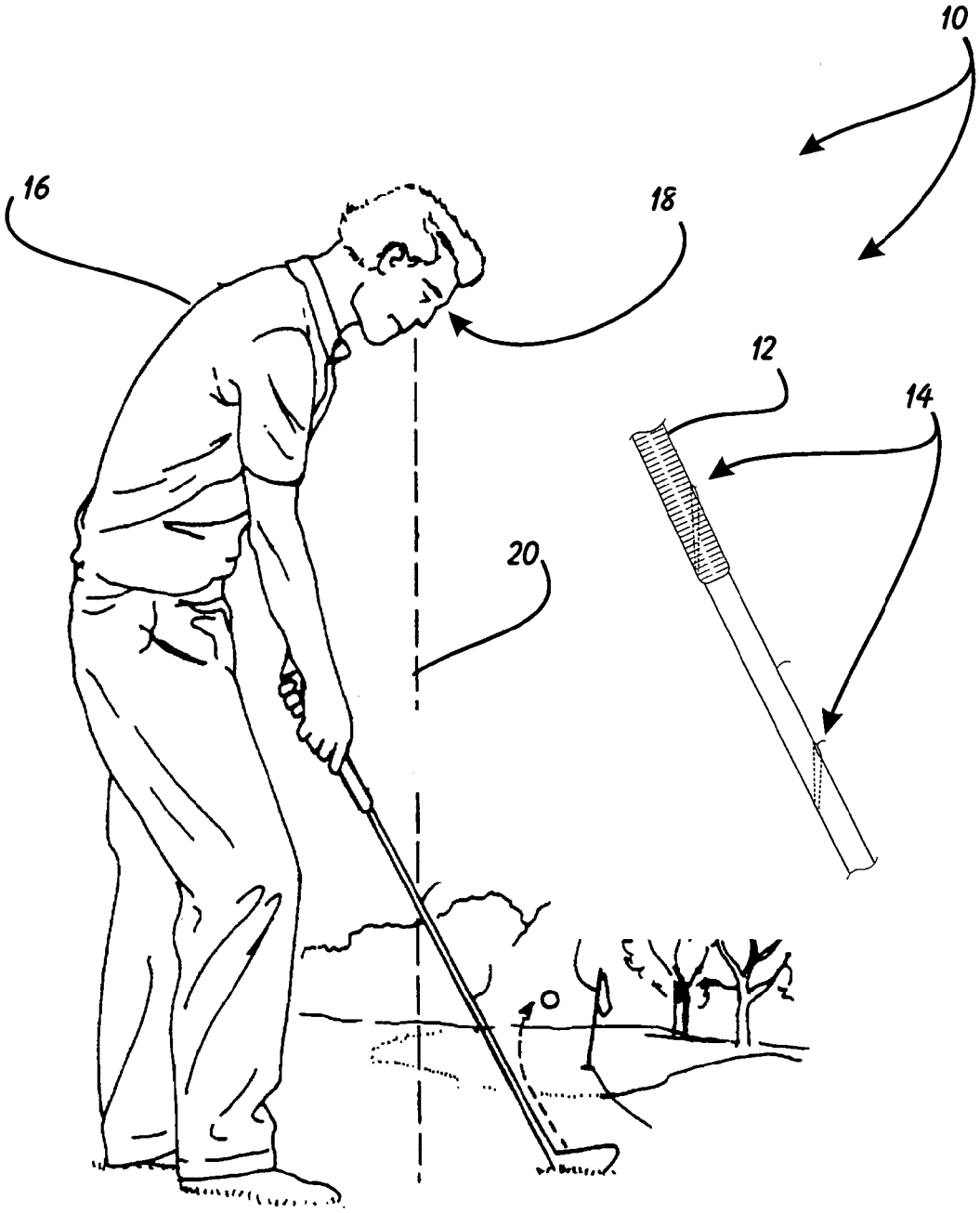
FIGURE 1 PRIOR ART
FIG. 1 depicts the prior art golf alignment aid of D'Amico.
Figure 2:
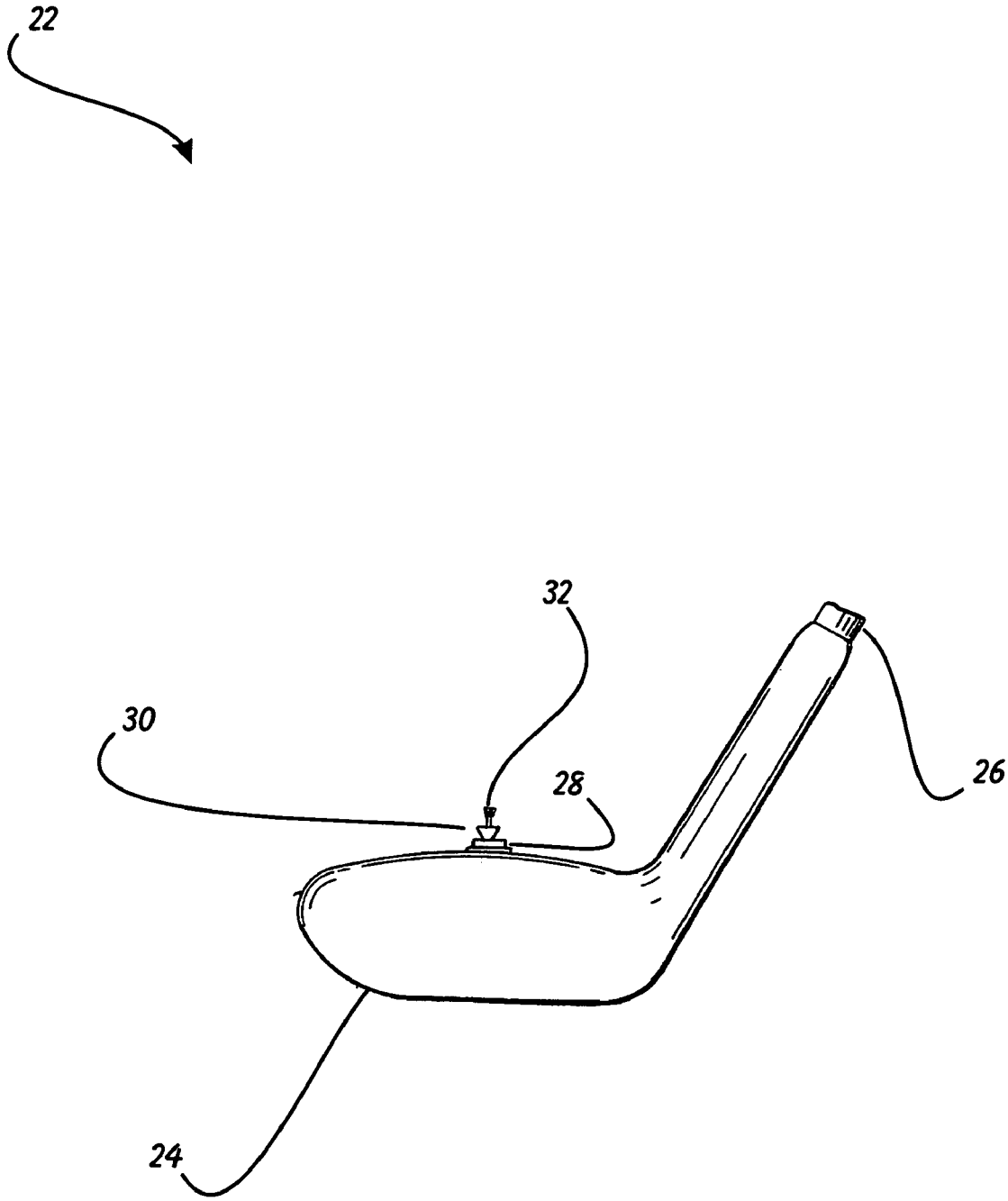
FIGURE 2 PRIOR ART
FIG. 2 depicts the prior art golf alignment aid of Sykes.
Figure 3:
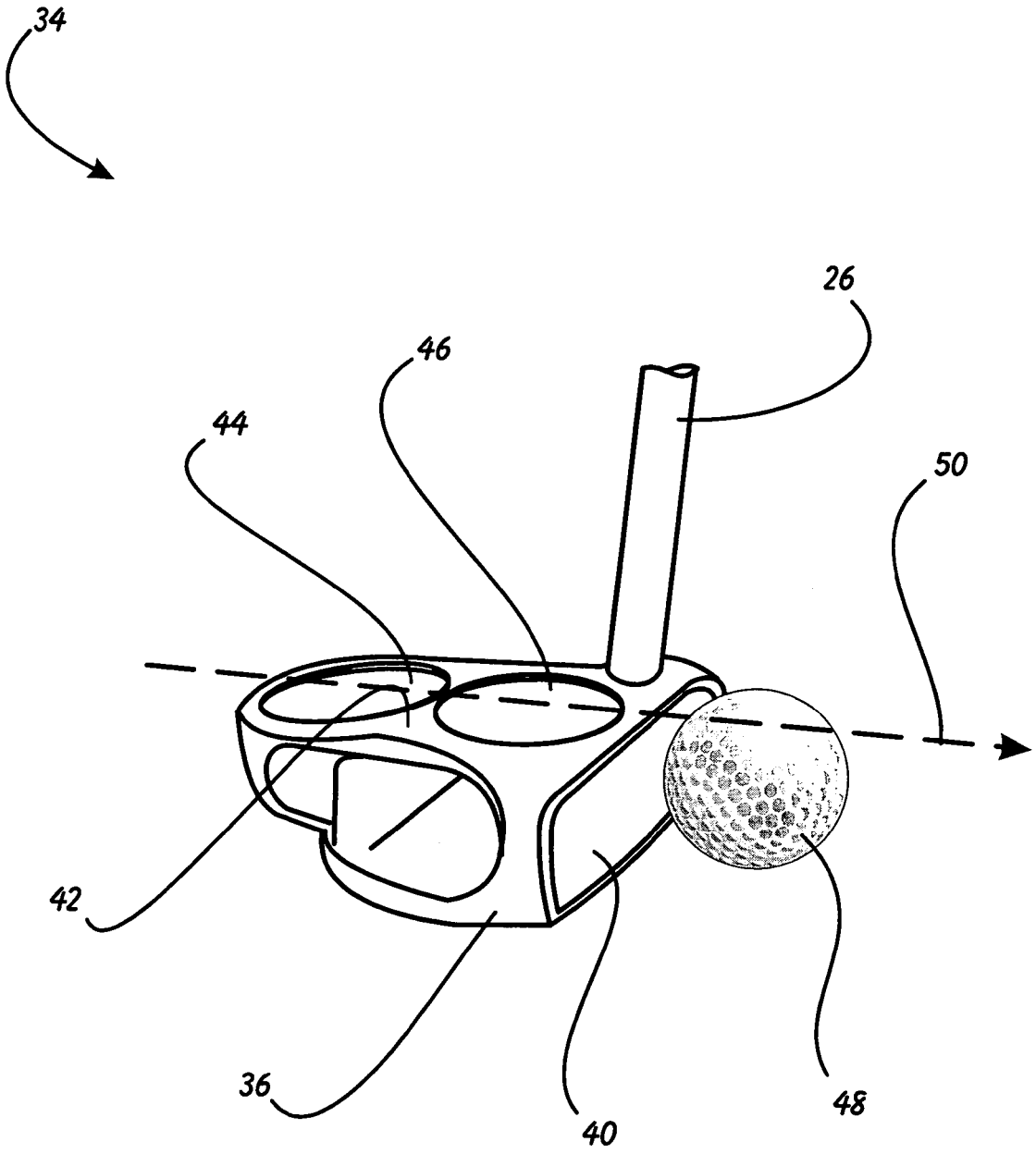
FIGURE 3 PRIOR ART
FIG. 3 depicts the prior art golf club alignment aid known as the "2-ball" head.
Figure 4:
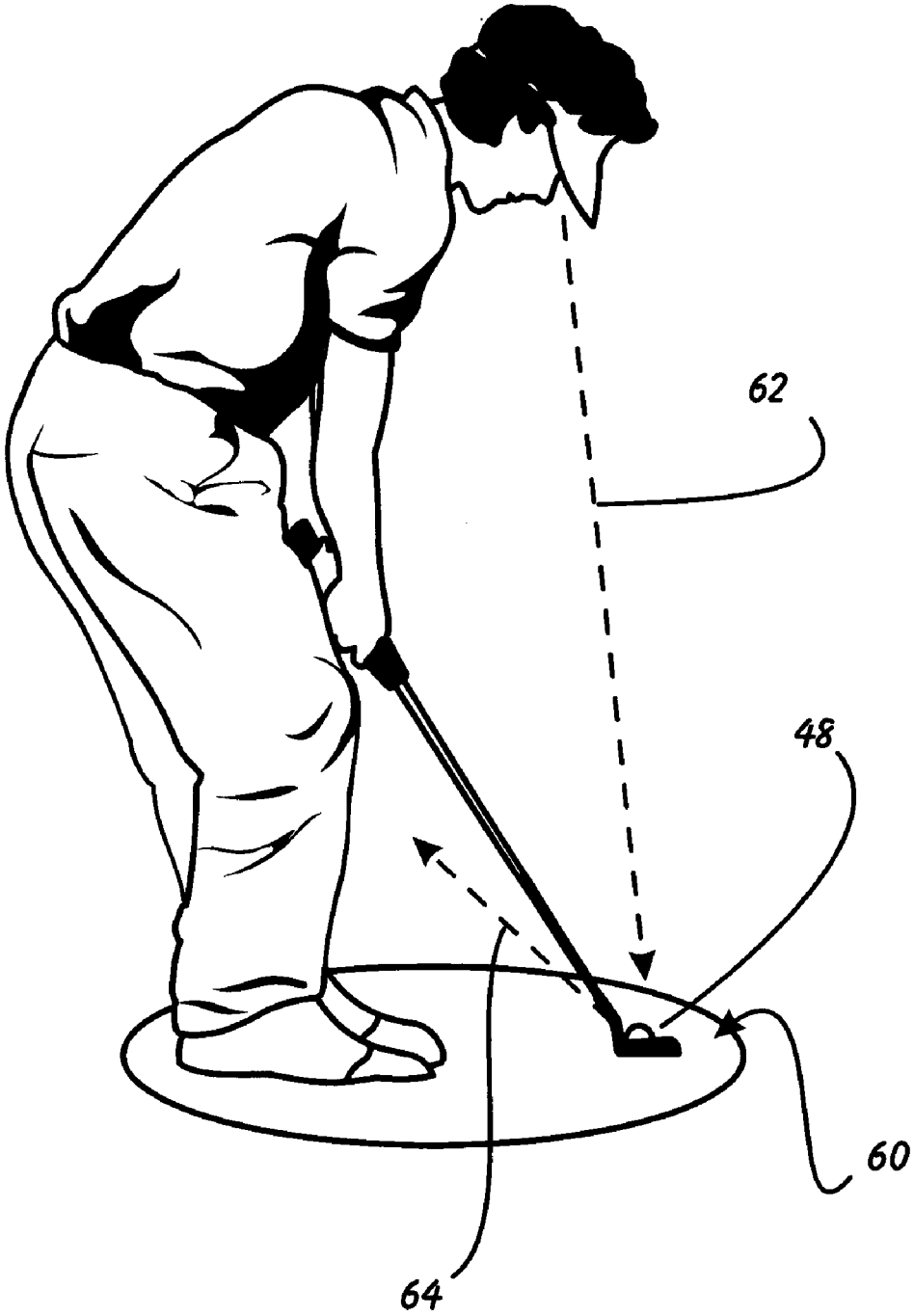
FIG. 4 is a side view of a golfer using a planar-parallactic club head of the present invention.
Figure 5:
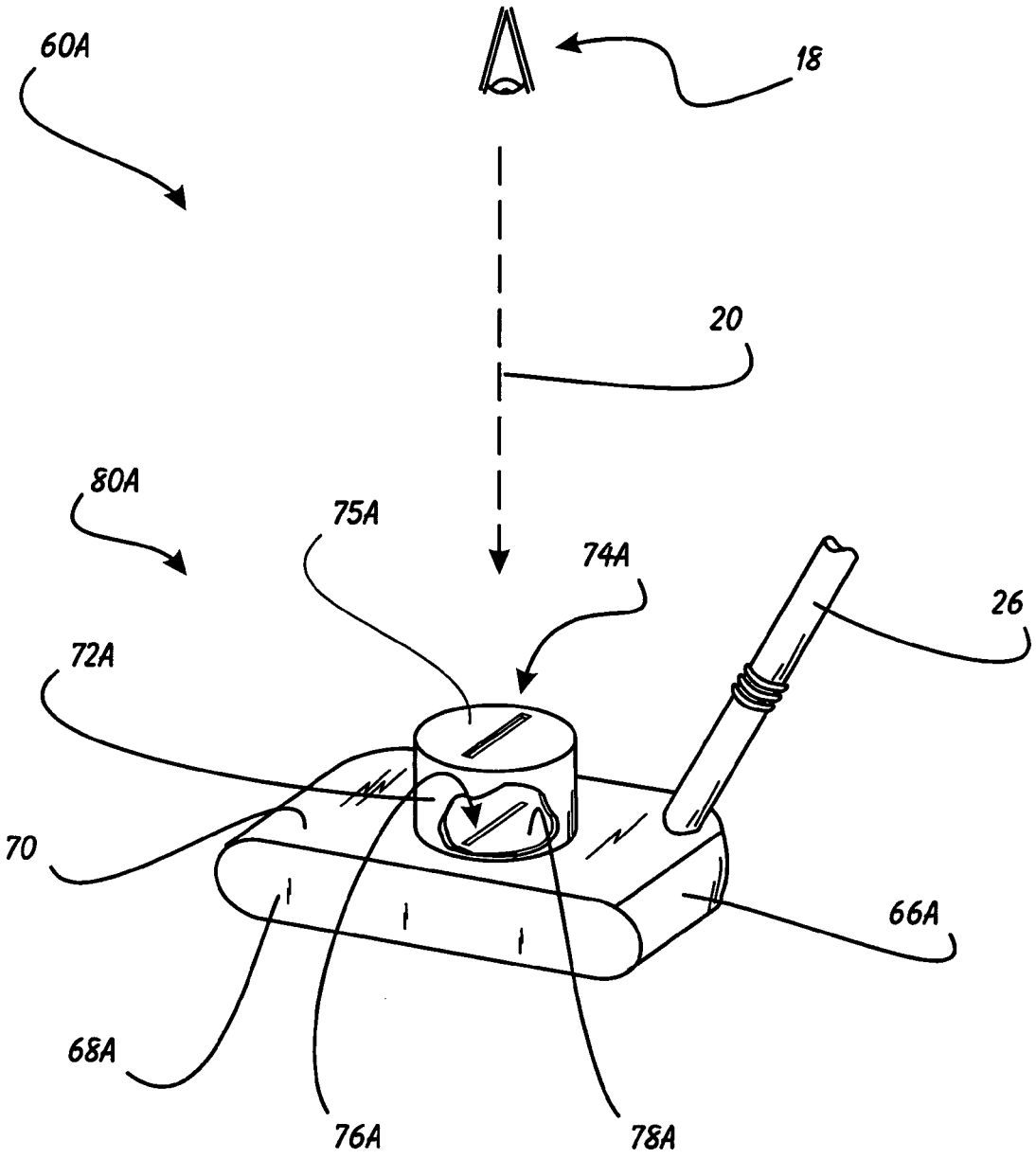
FIG. 5 is a perspective view of a preferred embodiment of the planar-parallactic club head of the present invention.

The present invention can best be understood by initial consideration of FIG. 4. FIG. 4 is a side view of a golfer using a planar-parallactic club head 60 of the present invention. As will be discussed further below, the head 60 provides the golfer with two alignment aides—a parallactic alignment sight line 62 for aligning the stance to the ball 48, and a planar alignment sight line 64 for aligning the club face to the ball and the shot's destination. Turning to FIG. 5, we can begin to discuss the details of the present invention.

FIG. 5 is a perspective view of a preferred embodiment of the planar-parallactic club head assembly 60A of the present invention. The head assembly 60A has a head 66A, which is defined by a face 68A and a top surface 70, and from which a shaft 26 extends. In this depiction, the club is a putter, although other clubs may be made that incorporate the planar-parallactic alignment aide.

The unique aspect of the planar-parallactic alignment assembly 80A is a dome 72A attached or otherwise formed atop the head 66A. The dome 60A has a slot 74A formed in its top surface 75A. The slot 74A is oriented such that it is perpendicular to the plane of the club face 68A and located horizontally such as to be aligned with the sweet spot of the face 68A.

When the golfer's eye 18 is aligned relative to the slot 74A such that the sight line 20 extends from the eye 18 through the slot 74A, the golfer will be able to see a illuminated line 76A projected as an image on the projection surface 78A (which in this case is the top surface 70 of the head 66A). The phenomena of parallax operates with the arrangement of the eye 18, slot 74A and the projected image 76A of the slot 74A on the projection surface 78A. As the eye 18 is moved from side to side relative to the head 66A, the golfer will only be able to actually see the projection image 76A through the slot 74A when the eye 18 is on the sight line 20 as designed.

A projection image 76A is employed for alignment with the slot 74A rather than a permanent mark on the projection surface 78A in order to provide the most versatility in the device 60A. If the dome top surface 75A is canted (placed at an angle), relative to the top surface 70 of the head 66A to allow for a sight line 20 at an angle that is not perpendicular to the club head top surface 70, the projection image 76A will move until it is directly perpendicular to the dome top surface 75A due to the filtering/focusing action that occurs with incident light at the slot 74A. This cantable dome will most likely be accomplished by cutting the slot/aperture at an angle off of vertical (i.e. a custom club head), depending upon the comfort, style and form of the golfer. If we now turn to FIG. 6, we can continue to examine the present invention.

Figure 6:
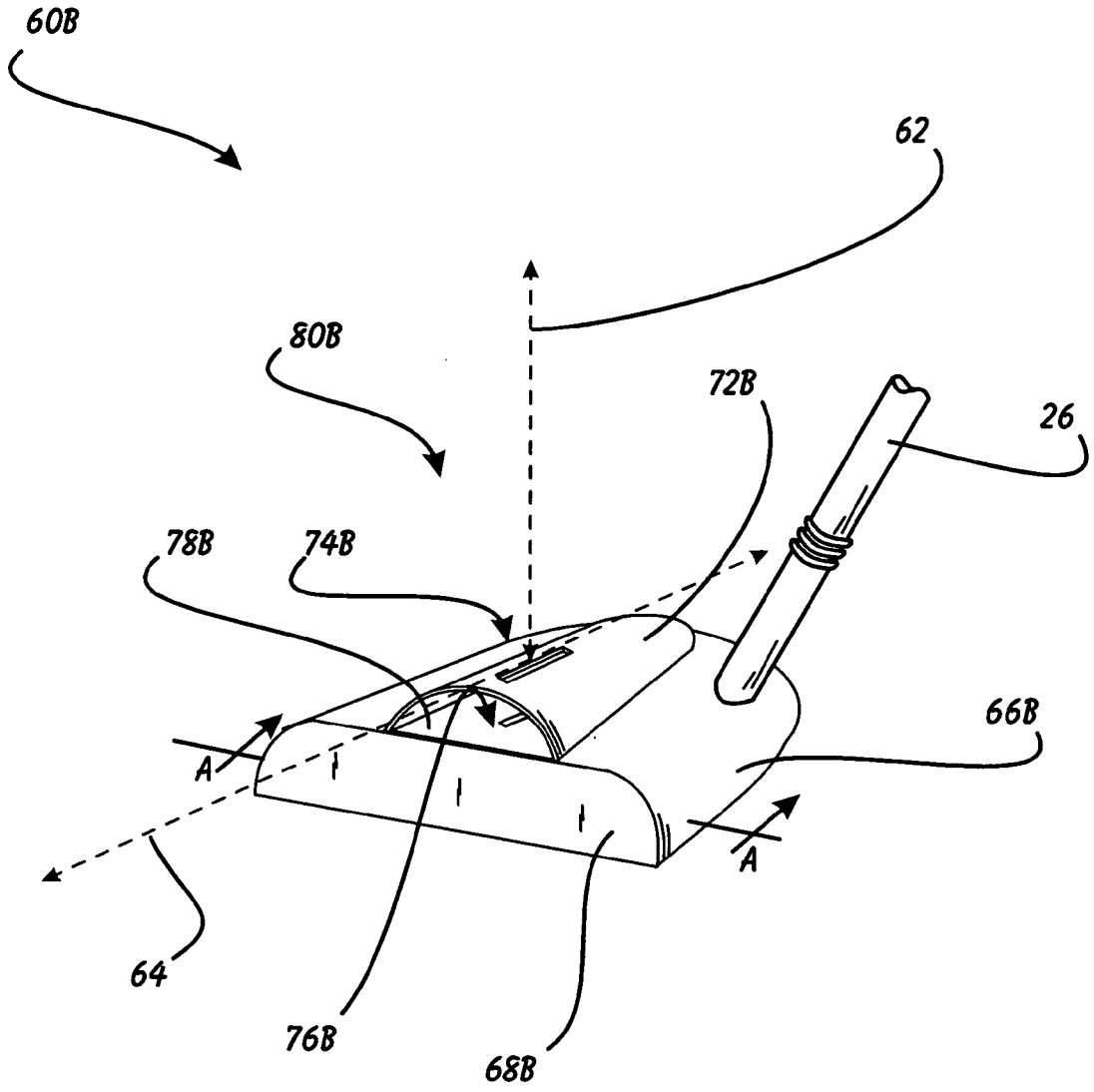
FIG. 6 is a perspective view of an alternate embodiment of the planar-parallactic club head of the present invention.

FIG. 6 is a perspective view of an alternate embodiment of the planar-parallactic club head assembly 60B of the present invention. The assembly 60B has a head 66B with a dome 72B mounted atop it. As with the previous embodiment, the dome 72B has a slot 74B formed in its top and a projected alignment image 76B of the slot 74B onto the projection surface 78B.

Figure 7:
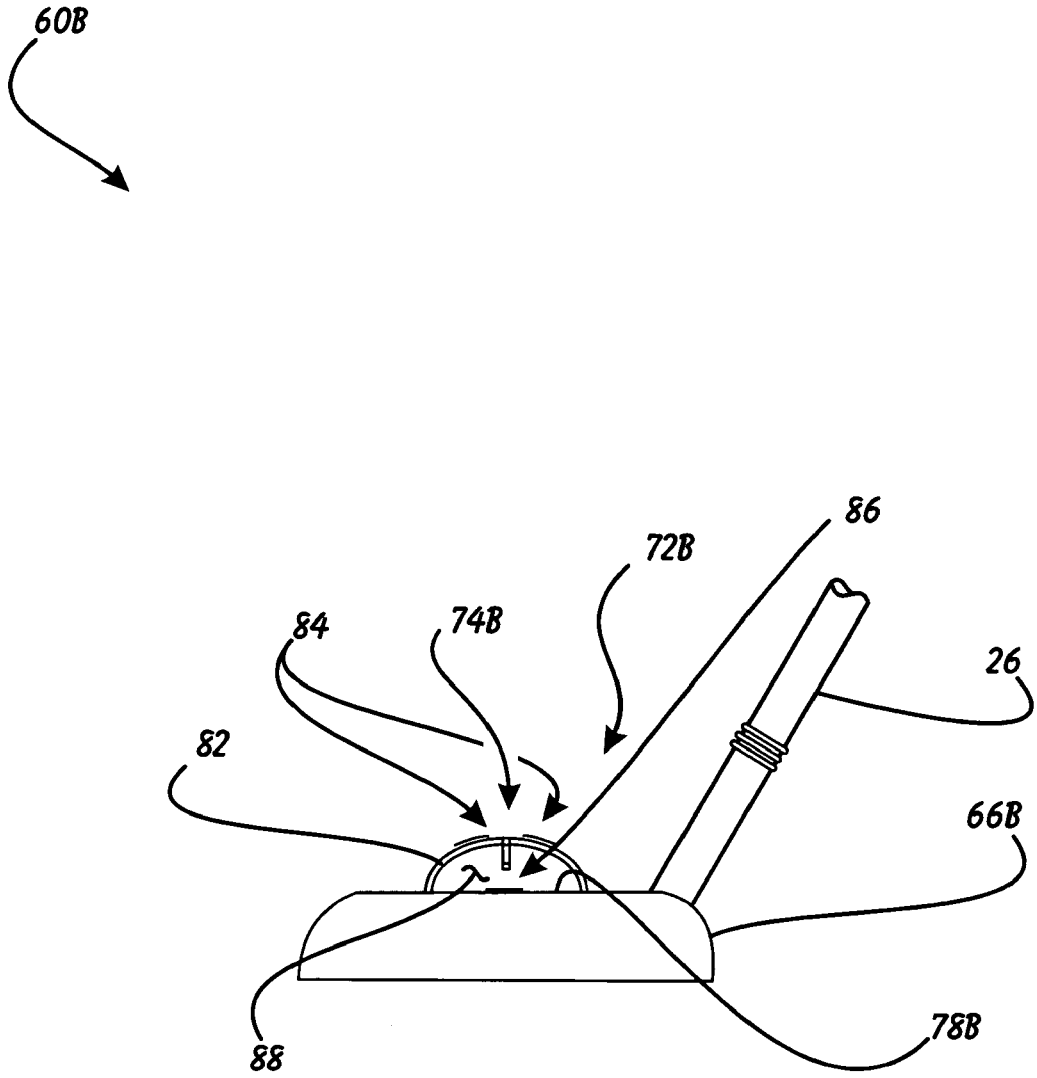
FIG. 7 is a front view of the head of FIG. 6.

The slot 74B is aligned relative to the face 68B to create a planar alignment sight line 64 along its length for alignment between the ball and the destination of the shot. As discussed above, the alignment between the slot 74B and projected image 76B forms the parallactic alignment sight line 62 for indicating to the golfer where the proper location for his or her eye and head. FIG. 7 provides additional detail of this novel design.

FIG. 7 is a front view of the head of FIG. 6 along line A—A. In order to provide greater visibility of the projected image, the dome 72B is constructed from clear material (such as plastic) having black portions 84 immediately adjacent and parallel to the slot 74B. As shown, the projection surface 78B is located at the bottom of the void 88 formed within the dome 72B. The projection surface 78B has a white portion 86 inscribed other otherwise displayed on the projection surface 78B such that the projected image appears very bright to aid the alignment to it through the slot 74B. Finally, turning to FIG. 7, we can have a look at another orientation of the device of the present invention.

Figure 8:
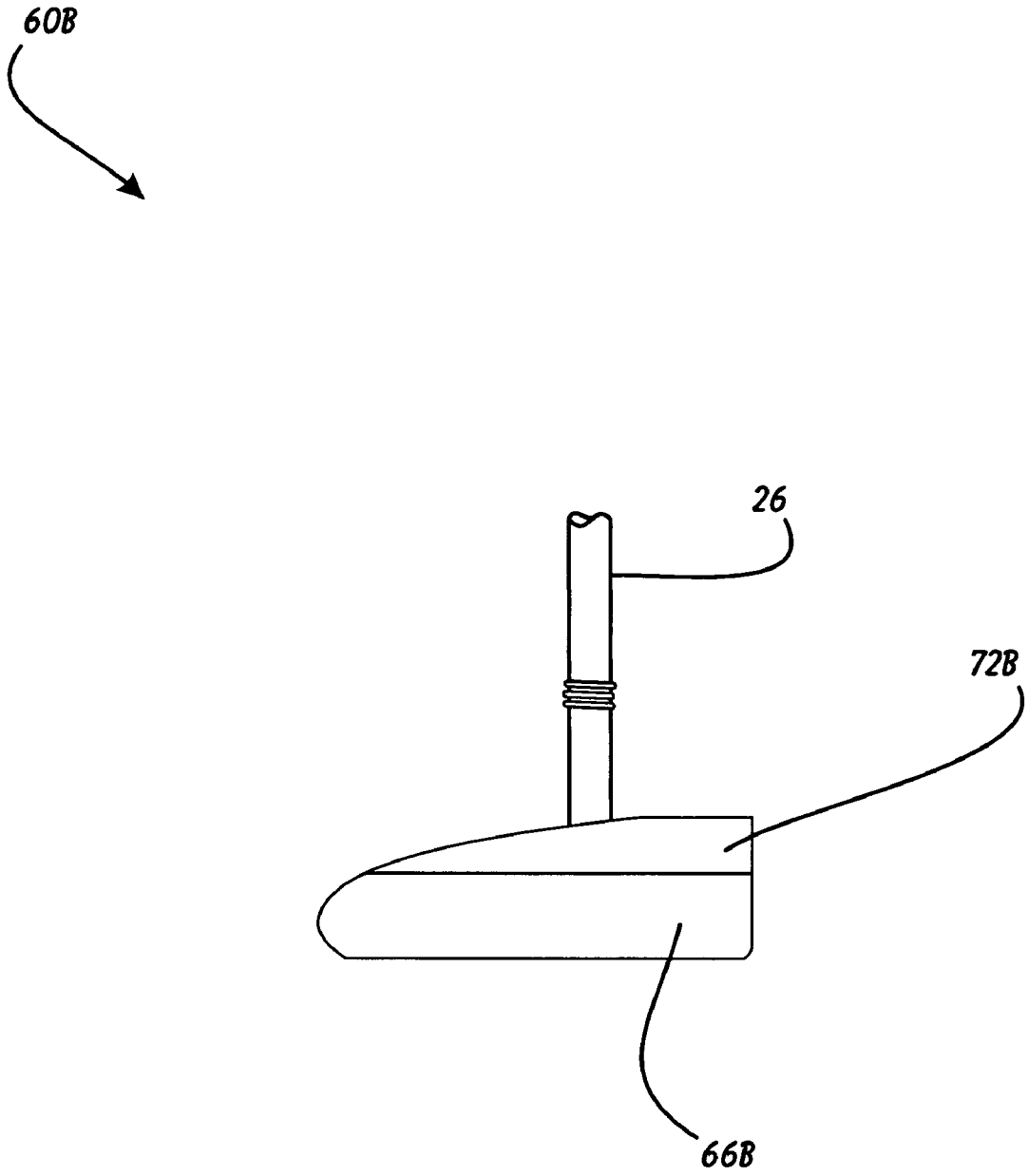
FIG. 8 is a side view of the head of FIGS. 6 and 7.

FIG. 8 is a side view of the head 60B of FIGS. 6 and 7. As can be seen, the profile of the head 66B and dome 72B is very sleek. This profile minimizes wind resistance and provides an aesthetically pleasing package. Other versions may be made, depending upon the particular purpose for the club and the user's wishes. An example of another club is shown in FIG. 9.

Figure 9:
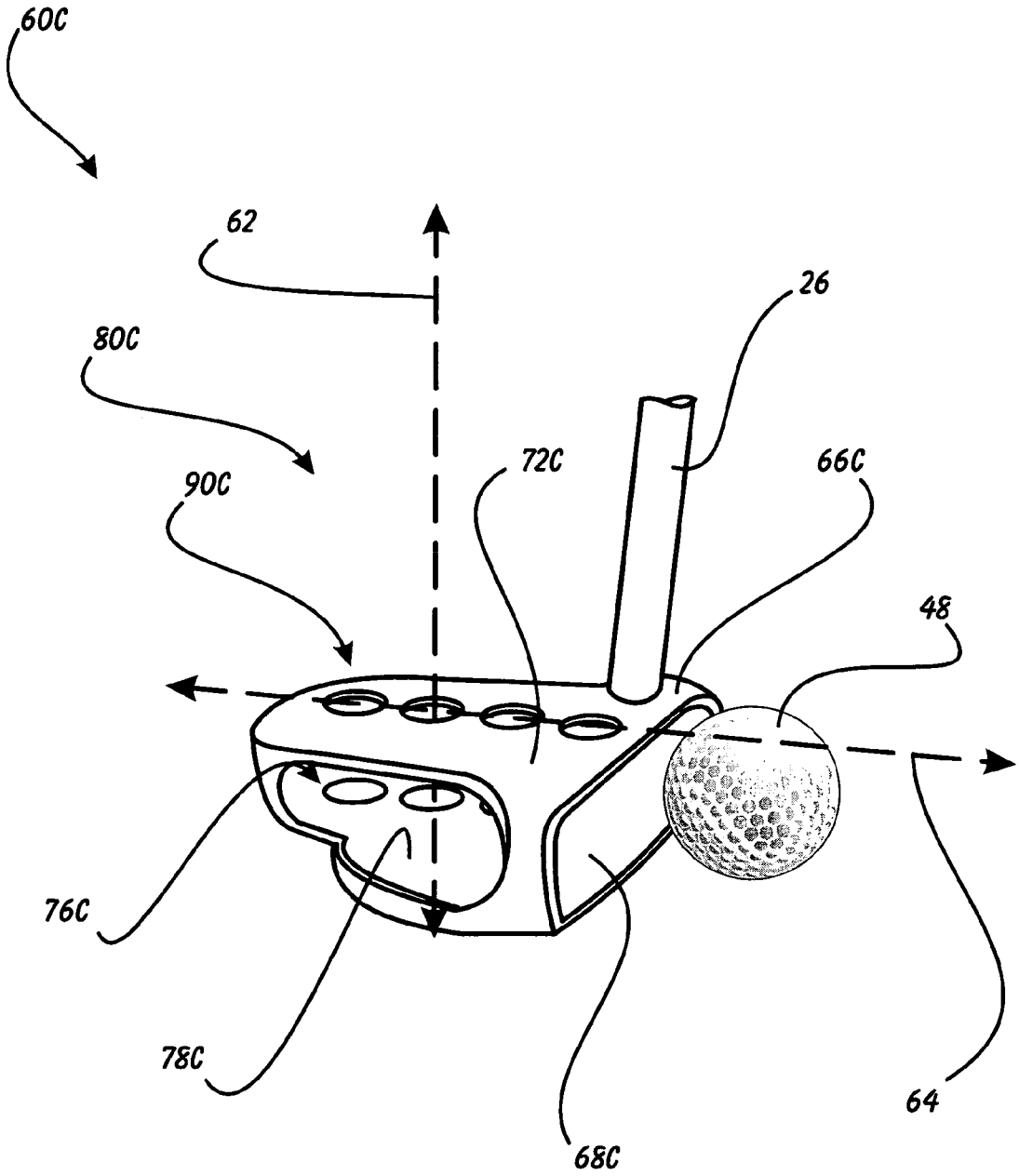
FIG. 9 is a perspective view of yet another alternate embodiment of the planar-parallactic club head of the present invention.

FIG. 9 is a perspective view of yet another alternate embodiment of the planar-parallactic club head 60C of the present invention. This version of the head 60 has a dome 72C that is actually the top of the club head 66C itself. As such, the additional complexity (and weight constraints) are eliminated by this design.

A further distinction in this version of the head 60C is that the alignment mechanism is a plurality of round apertures 90C, rather than the slot shown in previous designs. The apertures 90C are separate from one another, but are arranged in a line that is generally perpendicular to the face 68C as well as being aligned with the sweet spot of the club face 68C. This line of apertures 90C, then, combine to form the planar alignment sight line (for aligning the face 68C to the target).

Light passing through the apertures 90C will strike the projection surface 78C, where a projected image 76C (actually a line of images of the apertures) will be displayed for use to create the parallactic alignment sight line.

Although the previously-described embodiments are club heads with the dome integrated therein, it is expected that an "aftermarket" attachable dome device will be made available for attachment to a conventional putter or other club.

Throughout the previous discussions of the various designs, the term "projected image" is to be considered to be either an image of the slot, apertures, etc. formed by light passing through the slot, apertures, etc. and striking the "projection surface" (refer to this as a light-generated image), or an image that is actually inscribed on the projection surface that is then simply illuminated by light passing through the slot, apertures, etc. and any other ambient light that can strike the inscribed image (refer to this as an inscribed image). The inscribed image may be a line made from a fluorescent paint painted onto the projection surface, for example.

From the golfer's perspective, both the light-generated image and the inscribed image versions of the design will appear to be the same, and both will function to provide the parallactic alignment line. It should be understood that in many cases to work best, the distance between the top surface of the dome and the projection surface must be at least twice the width or thickness of the slot, aperture(s), etc., so that the image (either light-generated or inscribed) can only be seen when the golfer's eyes are properly aligned.

This distance limitation is not necessarily a mandatory aspect of the design, but it has been found through testing to be a suggested design rule.

Figures 10A, 10B:
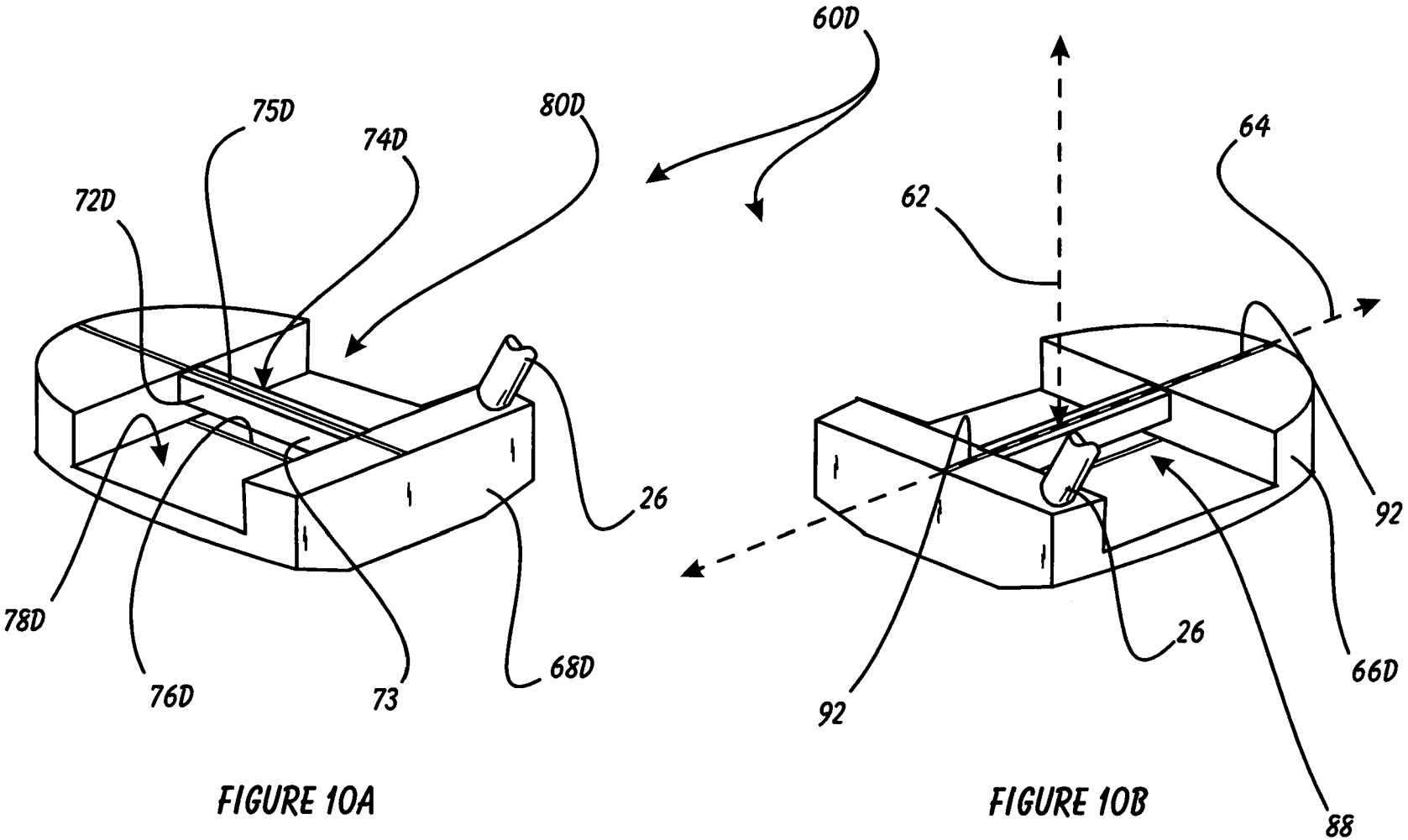
FIGS. 10A and 10B are front and rear perspective views of another alternate embodiment of the planar-parallactic club head of the present invention.

FIGS. 10A and 10B depict yet another version of the planar-parallactic club head 60D of the present invention. The head is defined by a face, top surface, a projection surface, a front thick portion adjacent to the face, a central thinner portion adjacent to the front thick portion and a rear thick portion in spaced relation to the front thick portion. The dome 72D, here, is essentially a cross bar 73 extending across the top surface of the head 66D such that a void 88 is formed between it and the projection surface 78D. The alignment image 76D is inscribed on the projection surface 78D to that it can be clearly seen through the slot 74D only when the golfer's eyes are aligned with the parallactic alignment sight line 62 (which is directly aligned along the direction that the slot 74D is cut into the cross bar 73.

The image 76D and the projection surface 78D will generally have contrasting colors applied to each so that the image 76D is easily viewed through the slot (particularly in the outdoor sunlight). In this version, the dome top surface 75D is flush or in planar alignment with the top surface of the head 66D, but this is not necessarily a critical parameter or relationship. Furthermore, the dome 72D/cross bar 73 may be made as an integral part of the head 66D, or it might be assembled from one or more inserts inserted into the head 66D (i.e. the parts could be manufactured separately). Still further, the height of the cross bar 73 may differ from head to head 60D; it is only critical that the height of the cross bar 73 is sufficient such that a slot 74D cut therethrough will be deep enough to provide a good alignment "tunnel" (if the slot depth is inadequate, a well-defined sight line 62 will not be created an the user will be able to view the image 76D even when the eye is not in perfect alignment with the sight line 62.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A golf club, comprising:

a head defined by a face, a top surface, a projection surface, a front thick portion adjacent to said face, a central thinner portion adjacent to said front thick portion, and a rear thick portion in spaced relation to said front thick portion, said projection surface disposed on said central thinner portion;

an alignment assembly comprising an elongate bar-shaped dome interconnecting said front thick portion and said rear thick portion perpendicular to said head face, said elongate bar-shaped dome defining a top surface and a bottom surface, said bottom surface in spaced relation to said projection surface; and an alignment image inscribed on said projection surface.

2. The club of claim 1, wherein said dome top surface having a slot formed therein.

3. The club of claim 2, wherein said slot defines a line that is generally perpendicular to said face.

4. The club of claim 3, further comprising first and second alignment lines inscribed on said top surface of said head, said first and second alignment lines are co-linear with said slot.

5. The club of claim 2, wherein said slot defines an axis that is aligned along a line that is generally perpendicular to said face.

6. The club of claim 5, further comprising said inscribed alignment image being inscribed on said projection surface, said slot further defining a parallactic sight line in alignment with said inscribed alignment image and said slot.

7. The club of claim 6, wherein said dome top surface is generally coplanar with said club head top surface.

8. The club of claim 7, wherein said projection surface, slot and said alignment image are oriented whereby said alignment image is aligned with said slot along a parallactic alignment sight line.

9. In combination with a golf club head an alignment assembly for attachment to said top surface of a golf club head, said head defined by a front face and a rear face, comprising:

a dome consisting essentially of an elongate bar having a top surface, a bottom surface, a first club-head-attaching end attachable in proximity to said head front face and a second club-head-attaching end attachable in proximity to said head rear face, and a projection surface associated with said club top surface, said elongate bar further defined by a slot formed between said top surface and said bottom surface, said projection surface further defined by an alignment image inscribed thereon; and a void defined between said dome bottom surface and said projection surface.

10. The assembly of claim 9, wherein said top surface further comprises at least one darkened portion of said surface adjacent to said slot.

11. The assembly of claim 10, wherein said projection surface further comprises a lightened portion.

12. The club of claim 9, further comprising first and second alignment lines inscribed on said top surface of said head, said first and second alignment lines are co-linear with said slot.

13. A golf club having a head defining a face and a top surface, the head comprising:

parallactic alignment means for defining a parallactic alignment sight line, said parallactic alignment means comprising a dome having a slot formed therethrough to define a parallactic alignment sight line interconnecting said slot with an alignment image, said dome defining an elongate bar shape having a first face and a second face parallel to said first face and a pair of opposing ends in perpendicular alignment to said head face, said opposing ends extending from a front thickened portion and a rear thickened portion, respectively, of said head; and planar alignment means for defining a planar alignment sight line.

14. The club of claim 13, wherein said slot associated with said club is oriented perpendicular to said face.

15. The club of claim 14, wherein said parallactic alignment means comprises a projection surface associated with said head opposite to said slot.

16. The club of claim 15, wherein said projection surface further comprises a lightened portion generally opposite to said slot.

17. The club of claim 14, further comprising first and second alignment lines inscribed on said top surface of said head, said first and second alignment lines are co-linear with said slot.

* * * * *